US010769979B2

(12) United States Patent
Chen et al.

(10) Patent No.: US 10,769,979 B2
(45) Date of Patent: Sep. 8, 2020

(54) PIXEL ARRANGEMENT STRUCTURE, DISPLAY PANEL AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Shiqi Chen, Beijing (CN); Ni Jiang, Beijing (CN); Bo Shi, Beijing (CN); Yin Deng, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 0 days.

(21) Appl. No.: 16/138,109

(22) Filed: Sep. 21, 2018

(65) Prior Publication Data

US 2019/0096310 A1 Mar. 28, 2019

(30) Foreign Application Priority Data

Sep. 22, 2017 (CN) ..... 2017 1 0872731

(51) Int. Cl.
*G09G 3/20* (2006.01)

(52) U.S. Cl.
CPC ... *G09G 3/2003* (2013.01); *G09G 2300/0426* (2013.01); *G09G 2300/0452* (2013.01)

(58) Field of Classification Search
CPC ..... G09G 3/2003; G09G 2300/0426; G09G 2300/0452
See application file for complete search history.

(56) References Cited

U.S. PATENT DOCUMENTS

2004/0017985 A1* 1/2004 Cok ..... G02B 6/06 385/120
2006/0050033 A1* 3/2006 Asao ..... G09G 3/3607 345/88
2009/0267870 A1* 10/2009 Schellingerhout ..... G02F 1/133305 345/55

(Continued)

FOREIGN PATENT DOCUMENTS

CN 203643726 U 6/2014
CN 205539855 U * 8/2016

(Continued)

OTHER PUBLICATIONS

First Office Action issued in corresponding Chinese Application No. 201710872731.9, dated Nov. 6, 2019, with English translation.

*Primary Examiner* — Mark W Regn

(57) ABSTRACT

A pixel arrangement structure includes a plurality of circular pixels. The plurality of circular pixels include a center pixel and a plurality of peripheral pixels located around the center pixel. Some of the plurality of peripheral pixels distributed on a same circumference with the center pixel as a center constitute a first pixel group, so as to form a plurality of first pixel groups on different circumferences respectively. Radiuses of circumferences of the plurality of first pixel groups respectively located on different circumferences gradually increase in a direction away from the center pixel.

7 Claims, 7 Drawing Sheets

(56) References Cited

U.S. PATENT DOCUMENTS

| | | | | |
|---|---|---|---|---|
| 2017/0052643 | A1* | 2/2017 | Iwami | G02F 1/13338 |
| 2017/0125490 | A1 | 5/2017 | Li et al. | |

FOREIGN PATENT DOCUMENTS

| | | | |
|---|---|---|---|
| CN | 205539855 | U | 8/2016 |
| CN | 206115897 | U | 4/2017 |
| CN | 106653792 | A | 5/2017 |
| CN | 106782097 | A | 5/2017 |
| WO | 2010039938 | A1 | 4/2010 |

* cited by examiner

PIXEL ARRANGEMENT STRUCTURE, DISPLAY PANEL AND DISPLAY DEVICE

CROSS-REFERENCE TO RELATED APPLICATION

This application claims priority to Chinese Patent Application No. 201710872731.9, filed on Sep. 22, 2017, titled "A PIXEL STRUCTURE, A DISPLAY PANEL AND A DISPLAY DEVICE", which is incorporated herein by reference in its entirety.

TECHNICAL FIELD

The present disclosure relates to the field of display technologies, and in particular, to a pixel arrangement structure, a display panel and a display device.

BACKGROUND

With the continuous development of display technologies, display devices are increasingly used in the field of smart wear. For example, display devices are used in some smart wearable products, such as smart watches and smart glasses.

SUMMARY

An aspect of the present disclosure provides a pixel arrangement structure. The pixel arrangement structure includes a plurality of circular pixels. The plurality of circular pixels include a center pixel and a plurality of peripheral pixels located around the center pixel, and a plurality of peripheral pixels distributed on a same circumference with the center pixel as a center constitute a first pixel group, so as to form a plurality of first pixel groups on different circumferences respectively. Radiuses of circumferences of the plurality of first pixel groups respectively located on different circumferences gradually increase in a direction away from the center pixel.

In some embodiments of the present disclosure, the pixel arrangement structure further includes at least two second pixel groups each of which is composed of some of the plurality of peripheral pixels. Peripheral pixels in each of the second pixel groups are respectively located on different circumferences in a direction close to or away from the center pixel, and in each of the second pixel groups, a center of each of the peripheral pixels is on a straight line as a center of the center pixel.

In some embodiments of the present disclosure, an angle between any two adjacent second pixel groups ranges from 58° to 62°.

In some embodiments of the present disclosure, each of the plurality of circular pixels is configured to emits light of a single color, and a color of light emitted by one circular pixel is different from a color of light emitted by any one of circular pixels adjacent to the one circular pixel.

In some embodiments of the present disclosure, at least two peripheral pixels sequentially away from the center pixel in the second pixel group and the center pixel constitute a pixel unit for emitting white light.

In some embodiments of the present disclosure, among the plurality of circular pixels, at least the center pixel includes at least three sub-pixels, and any two of the at least three sub-pixels have equal areas. The at least three sub-pixels constitute a pixel unit for emitting white light.

Another aspect of the present disclosure provides a display panel. The display panel includes any one of the pixel arrangement structures described above.

In some embodiments of the present disclosure, each of the plurality of circular pixels in the pixel arrangement structure emits of light of a single color, and peripheral pixels in each of first pixel groups in the pixel arrangement structure are connected to a same gate line. Peripheral sub-pixels whose centers are on a same straight line and in different first pixel groups are connected to a same data line.

In some embodiments of the present disclosure, the center pixel and peripheral pixels in a first pixel group closest to the center pixel are connected to a same gate line.

In some embodiments of the present disclosure, the center pixel and the peripheral pixels connected to the same gate line are connected to different data lines.

In some embodiments of the present disclosure, in cases where the pixel arrangement structure includes second pixel groups and all peripheral pixels closest to the center pixel are located in different second pixel groups, the center pixel and peripheral pixels other than the peripheral pixels closest to the center pixel are connected to a same data line.

Yet another aspect of the present disclosure provides a display device. The display device includes any one of the display panels described above.

DETAILED DESCRIPTION

Technical solutions in embodiments of the present disclosure will be described clearly and completely with reference to the accompanying drawings in the embodiments of the present disclosure. Obviously, the embodiments described are merely some but not all of embodiments of the present disclosure. All other embodiments made on the basis of the embodiments of the present disclosure by a person of ordinary skill in the art without paying any creative effort shall be included in the protection scope of the present disclosure.

Figure 1A:
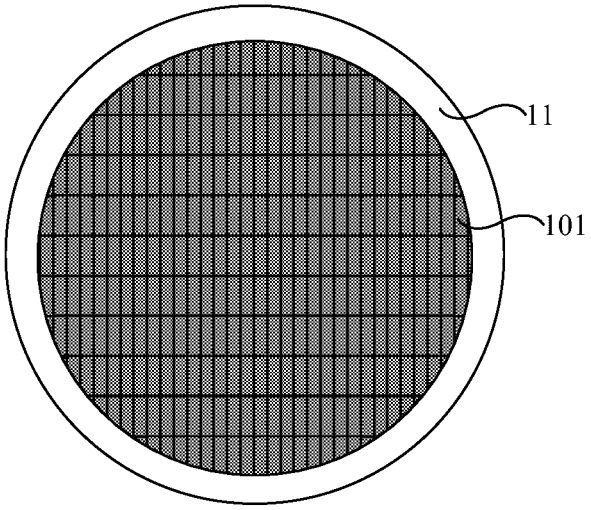
FIG. 1*a* is a schematic diagram showing a structure of a circular display device according to some embodiments of the present disclosure.
Figure 1B:
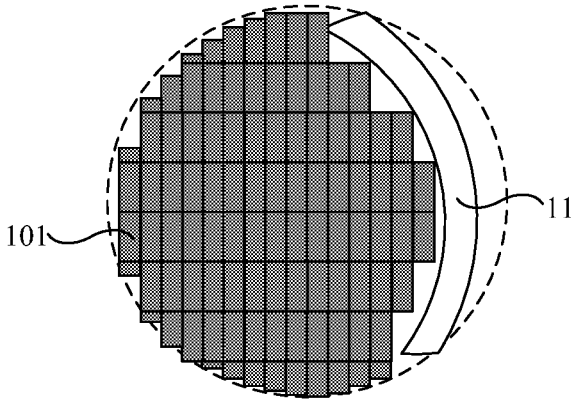
FIG. 1*b* is a schematic diagram showing a partial structure of a circular display device according to some embodiments of the present disclosure.

In order to meet exterior design requirements of smart wearable products, and for ergonomic considerations, display areas of the smart wearable products are usually round. As shown in FIG. 1*a*, an annular bezel 11 is used to form a circular display area in which rectangular sub-pixels 101 are disposed. In this case, as shown in FIG. 1*b*, an edge formed by the sub-pixels 101 exposed near the bezel 11 is jagged. Therefore, during a display process, a periphery of the display area appears to be jagged, thereby affecting the display effect.

Figure 2:
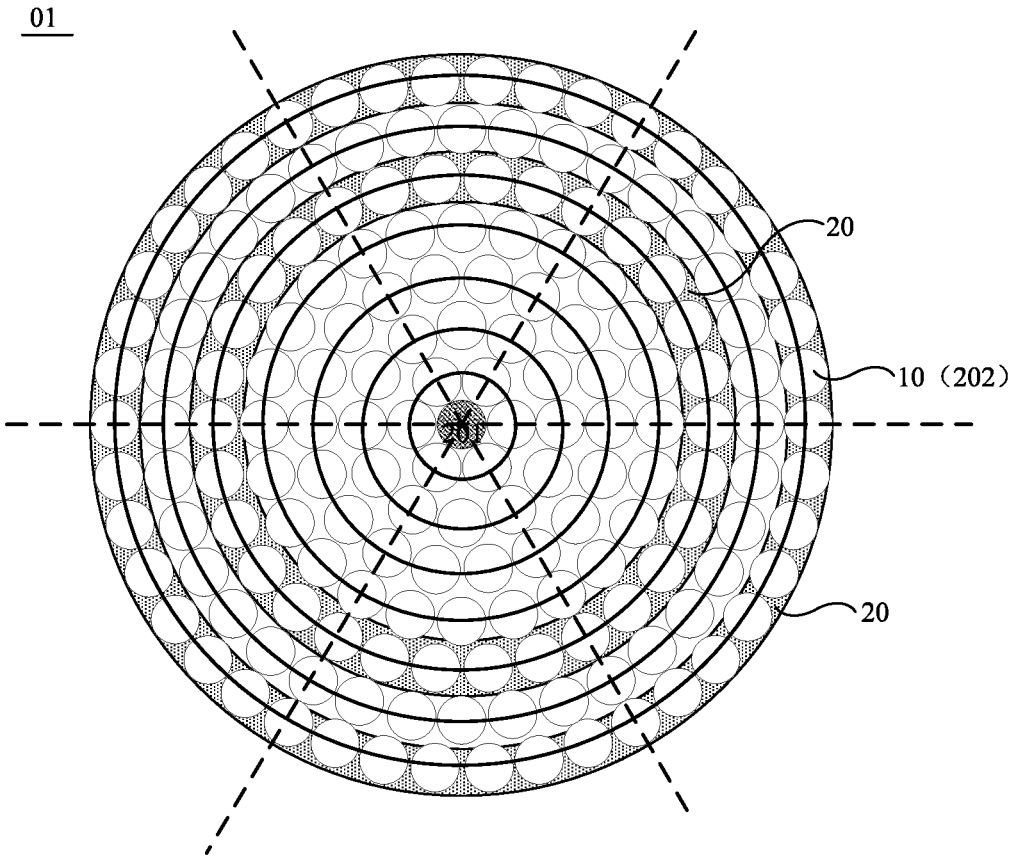
FIG. 2 is a schematic diagram of a pixel arrangement structure according to some embodiments of the present disclosure.
Figure 3:
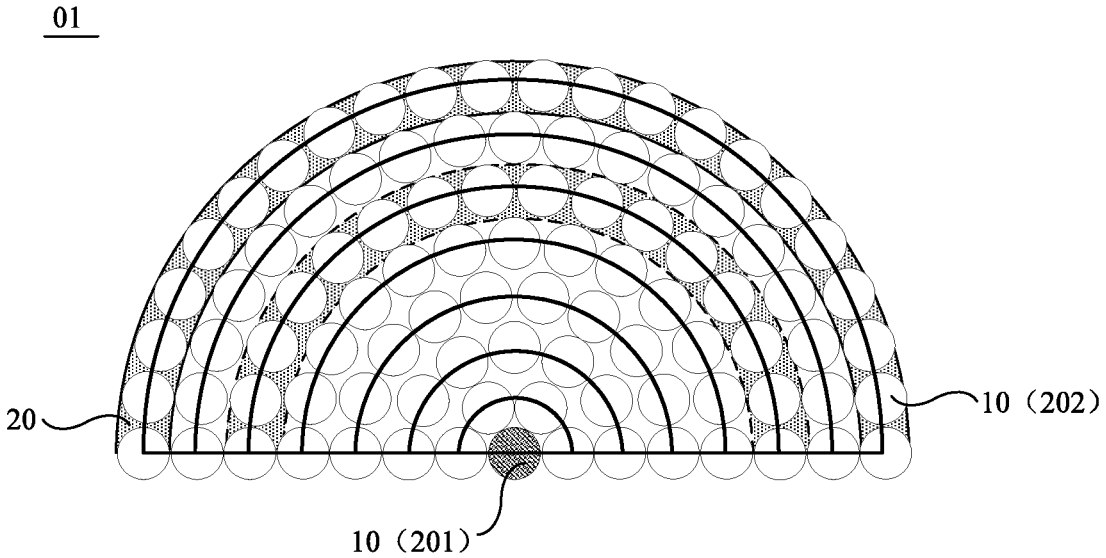
FIG. 3 is a schematic diagram of another pixel arrangement structure according to some embodiments of the present disclosure.

Some embodiments of the present disclosure provide a pixel arrangement structure 01. As shown in FIGS. 2 and 3, the pixel arrangement structure includes a plurality of circular pixels 10. The plurality of circular pixels 10 include a center pixel 201 and a plurality of peripheral pixels 202 located around the center pixel 201. Some of the plurality of peripheral pixels 202 distributed on a same circumference with the center pixel 201 as a center form a first pixel group 20. That is, centers of the plurality of peripheral pixels 202 in a same first pixel group 20 are located on a same circumference, and the circumference is concentric with the center pixel 201.

On this basis, the pixel arrangement structure 01 above includes a plurality of first pixel groups 20 having different circumferences, and radiuses of circumferences of first pixel groups 20 on different circumferences gradually increase in a direction away from the center pixel 201. That is, the radiuses of the circumferences where the plurality of first pixel groups 20 are located gradually increase in a direction away from the center pixel 201.

Figure 4:
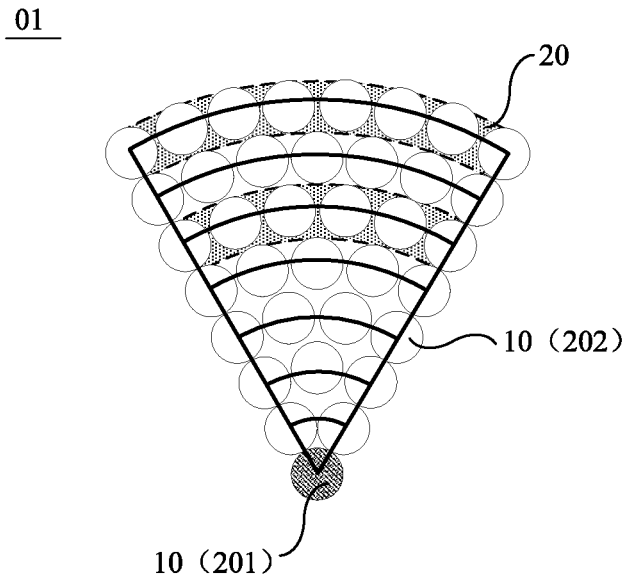
FIG. 4 is a schematic diagram of yet another pixel arrangement structure according to some embodiments of the present disclosure.

In some examples, the above-mentioned pixel arrangement structure 01 is of a circle shape as shown in FIG. 2. In some other examples, the pixel arrangement structure 01 is of a semicircle shape as shown in FIG. 3. In some other examples, the pixel arrangement structure 01 is of a quarter-circle shape as shown in FIG. 4. The present disclosure does not limit the shape of the pixel arrangement structure 01 as long as it is ensured that the pixel arrangement structure 01 is at least a part of a circle.

Figure 5:
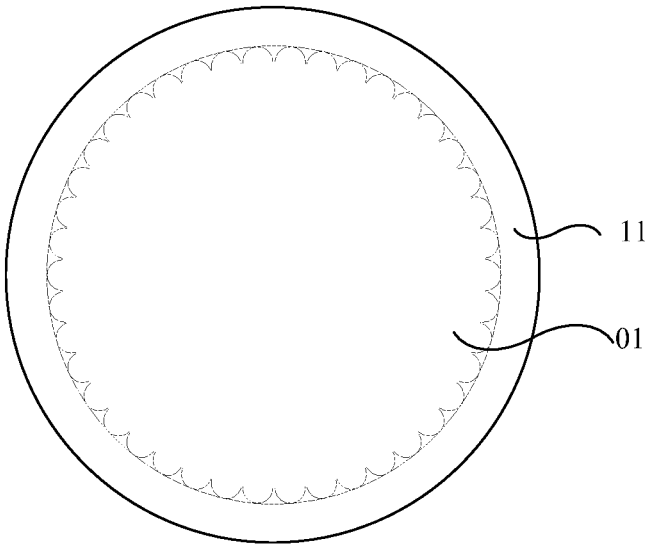
FIG. 5 is a schematic diagram showing a structure of a display device having the pixel arrangement structure shown in FIG. 2.

As can be seen from the above, the plurality of first pixel groups 20 formed by the plurality of peripheral pixels 202 are distributed around the center pixel 201 as concentric circles of the center pixel 201, and the center pixel 201 and the peripheral pixels 202 are both circular pixels 10. In this case, pixels at a farthest edge of the pixel arrangement structure 01 are composed of peripheral pixels 202 in a first pixel group 20 farthest from the center pixel 201 in the pixel arrangement structure 01. In this way, the edge of the pixel arrangement structure 01 is formed by splicing a partial arc of a profile of each of the plurality of peripheral pixels 202 together, as shown in FIG. 5. The arc will make a sawtooth edge of the pixel arrangement structure 01 less conspicuous, so that the sawtooth edge will not be as distracting to users during the display process, thereby improving the display effect.

On this basis, in a case where the pixel arrangement structure 01 provided by the present disclosure is adopted in a display device, since the sawtooth edge of the pixel arrangement structure 01 is less conspicuous, the bezel 11 exposes all of the peripheral pixels 202 at the edge of the pixel arrangement structure 01, as shown in FIG. 5. In this way, the bezel 11 does not need to shield the peripheral pixels 202 at the edge of the pixel arrangement structure 01, so that areas corresponding to sub-pixels of different colors in the peripheral pixels 202 near the bezel 11 may be prevented from being unequal, thereby avoiding the problem of color cast caused by unequal areas of the above-mentioned sub-pixels.

Figure 6:
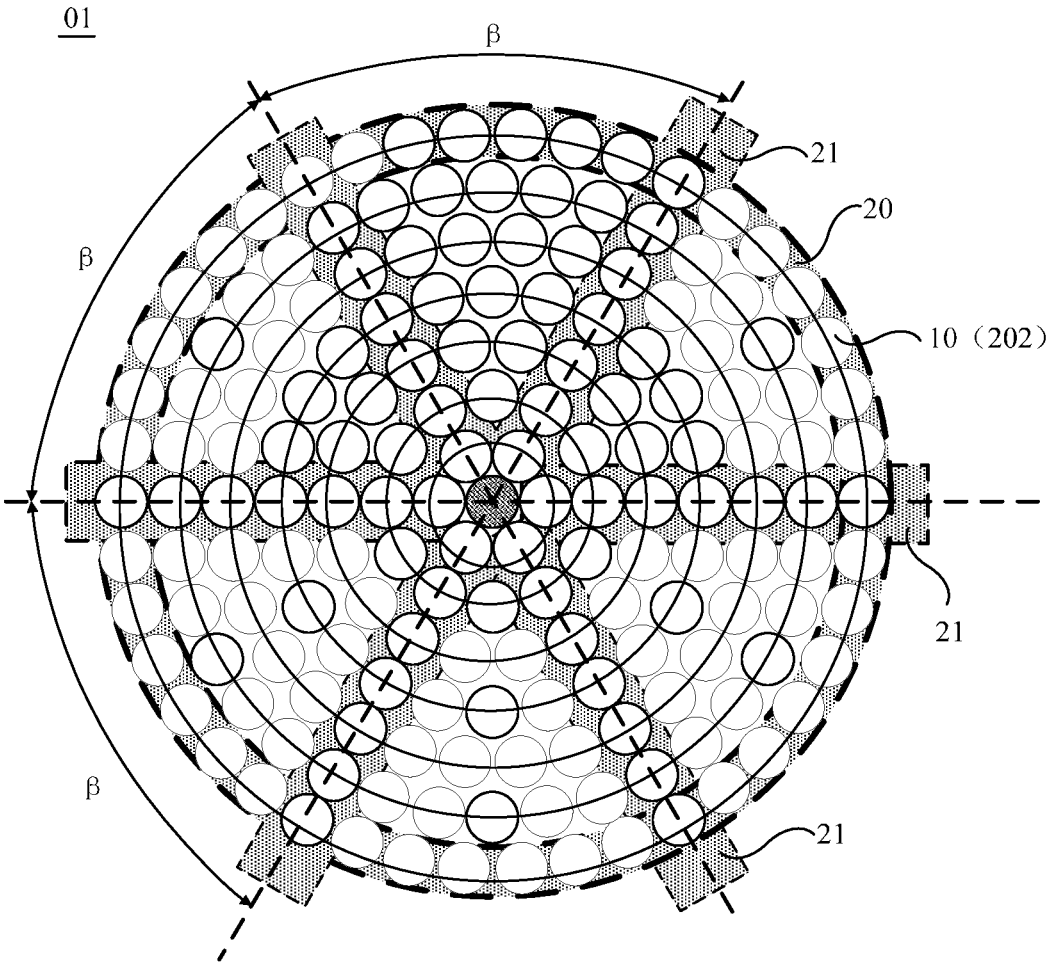
FIG. 6 is a schematic diagram showing an arrangement of peripheral pixels in the pixel arrangement structure shown in FIG. 2.

On this basis, taking an example in which the pixel arrangement structure 01 is of a circle shape, in a case of the above arrangement of the peripheral pixels 202 in the pixel arrangement structure 01, as shown in FIG. 6, the pixel arrangement structure 01 includes at least two second pixel groups 21 each of which is composed of some of the plurality of peripheral pixels 202. In FIG. 6, the pixel arrangement structure 01 including six second pixel groups 21 is taken as an example for description, in which a second pixel groups 21 is arranged on each of left and right sides of the center pixel 201, and two second pixel groups 21 are arranged on each of upper and lower sides of the center pixel 201.

Peripheral pixels 202 in each of the second pixel groups 21 are respectively located on different circumferences in a direction close to or away from the center pixel 201. In each of the second pixel groups 21, a center of each of the peripheral pixels 202 is on a same straight line as a center of the center pixel 201. In this way, an arrangement of the peripheral pixels 202 in the pixel arrangement structure 01 may be more orderly through providing the second pixel group 21 described above.

As can be seen from the above, the peripheral pixels 202 in each of the second pixel groups 21 are respectively located on different circumferences in a direction close to or away from the center pixel 201, and the peripheral pixels 202 in each of the first pixel groups 20 are located on a same circumference. Therefore, as shown in FIG. 6, the peripheral pixels 202 in a second pixel group 21 belong to different first pixel groups 20. That is, the peripheral pixels 202 in the first pixel groups 20 and the peripheral pixels 202 in the second pixel groups 21 are cross-multiplexed. It will be noted that, herein, orientation terms such as "left", "right", "upper" and "lower" are defined according to schematically placed orientations of the pixel arrangement structure in the drawings. It will be understood that these directional terms are relative concepts that are used for relative description and clarification, which may vary accordingly depending on variation of the orientation in which the pixel arrangement structure is placed.

In some embodiments of the present disclosure, an angle β between any two adjacent second pixel groups 21 is in a range of 58° to 62°. In this way, in cases where the angle β is less than 58° or greater than 62°, an area defined between any two adjacent second pixel groups 21 varies greatly. Therefore, when the angle β is in the range of 58° to 62°, an area of the pixel arrangement structure 01 may be approximately equally divided by the above-described six second pixel groups 21, so that the area defined between any two adjacent second pixel groups 21 is approximately equal, so that a number of peripheral pixels 202 disposed between any two adjacent second pixel groups 21 is approximately equal, thereby improving a uniformity of distribution of the peripheral pixels 202.

In some embodiments of the present disclosure, the angle β is 59°, 60°, 61°, or 62°.

On this basis, in a case where fabrication precision is high, in some embodiments of the present disclosure, the angle β between any two adjacent second pixel groups 21 is 60°, so that the number of peripheral pixels 202 disposed between any two adjacent second pixel groups 21 is completely equal.

In this case, in order to realize color display, an arrangement manner of the center pixel 201 and the peripheral pixels 202 will be illustrated below in combination with colors of light emitted by the circular pixels 10 in the pixel arrangement structure 01 taking the pixel arrangement structure 01 shown in FIG. 6 as an example.

Figure 7:
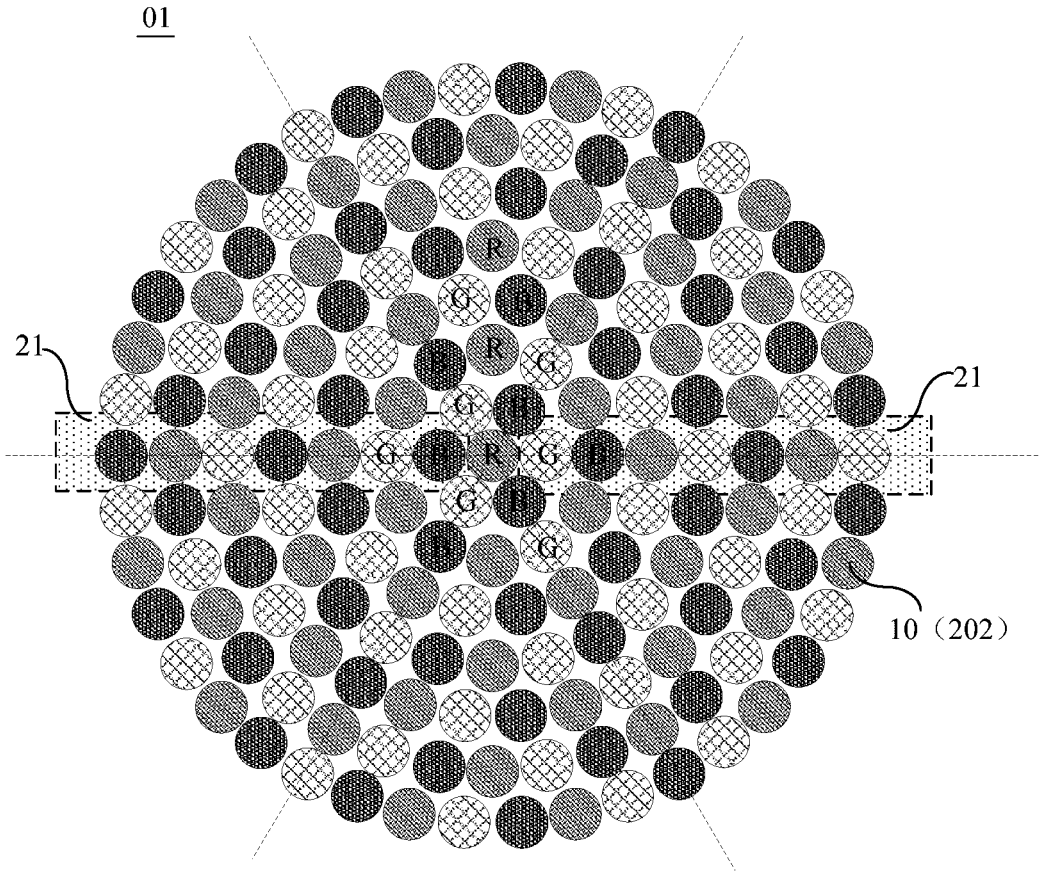
FIG. 7 is a schematic diagram showing an arrangement of each of circular pixels in the pixel arrangement structure shown in FIG. 2 when color display is realized based on the pixel arrangement structure.

For example, as shown in FIG. 7, each of the plurality of circular pixels 10 emits light of a single color, and light emitted by one circular pixel 10 is different in color from light emitted by any one of the circular pixels 10 adjacent to the one circular pixel 10.

Taking the center pixel 201 as an example, the center pixel 201 emits red light (R). In this case, peripheral pixels 202 closest to the center pixel 201, i.e., peripheral pixels 202 adjacent to the center pixel 201, emit green light (G) or blue light (B).

On this basis, at least two peripheral pixels 202 that are sequentially away from the center pixel 201 in a second pixel group 21 and the center pixel 201 constitute a pixel unit for emitting white light.

For example, the second pixel groups 21 located on the left and right sides of the center pixel 201 are shown in FIG. 7. The peripheral pixels 202 that are sequentially away from the center pixel 201 in the second pixel group 21 on the left side of the center pixel 201 emit blue light (B) and green light (G), respectively. In this case, two peripheral pixels 202 that are sequentially away from the center pixel 201 in the second pixel group 21 on the left side of the center pixel 201 and the center pixel 201 constitute a pixel unit for emitting white light.

In addition, in the second pixel group 21 on the left side of the center pixel 201, in addition to the two peripheral pixels 202 that emit blue light (B) and green light (G), which constitute the pixel unit for emitting white light with the center pixel 201, of remaining peripheral pixels 202 in the second pixel group 21 on the left side of the center pixel 201, three peripheral pixels 202 that emit red light (R), blue light (B), and green light (G) in order in a direction away from the center pixel 201 (i.e., from right to left) constitute one pixel unit. The peripheral pixels 202 that are sequentially away from the center pixel 201 in the second pixel group 21 on the right side of the center pixel 201 emit green light (G) and blue light (B), respectively. In this case, two peripheral pixels 202 that are sequentially away from the center pixel 201 in the second pixel group 21 on the right side of the center pixel 201 and the center pixel 201 constitute a pixel unit for emitting white light.

In addition, in the second pixel group 21 on the right side of the center pixel 201, in addition to the two peripheral pixels 202 that emit green light (G) and blue light (B), which constitute the pixel unit for emitting white light with the center pixel 201, of remaining peripheral pixels 202 in the second pixel group 21 on the right side of the center pixel 201, three peripheral pixels 202 that emit red light (R), green light (G), and blue light (B) in order in a direction away from the center pixel 201 (i.e., from left to right) constitute one pixel unit.

It will be noted that, there are only peripheral pixels 202 that emit green light (G) and blue light (B) in the peripheral pixels 202 located on a first circumference around the center pixel 201, i.e., in the peripheral pixels constituting a first pixel group closest to the center pixel 201, in FIG. 7. In this case, in order to make the entire pixel arrangement structure 01 emit uniform light, an intensity of an electric field of the center pixel 201 may be increased, so that a luminance of the red light (R) emitted by the center pixel 201 is increased. A luminance of light emitted by the peripheral pixels 202 located on the first circumference may be correspondingly reduced, so that white light emitted by a central portion of the pixel arrangement structure 01 is uniform.

In addition, numbers of peripheral pixels 202 emitting green light (G), blue light (B), and red light (R) respectively in a first pixel group 20 away from the center pixel 201 are substantially the same, so that each of the first pixel groups 20 (i.e., a plurality of peripheral pixels 202 located on a circumference) emits a uniform white color.

It will be noted that the above description is made by taking an example in which circular pixels 10 that emit green light (G), blue light (B), and red light (R) constitute a pixel unit that emits white light. In addition, the circular pixels 10 constituting the pixel unit that emits white light may also emit green light (G), blue light (B), red light (R), and white light (W), respectively; or emit cyan light, magenta light, and yellow light, respectively, which is not limited in the present disclosure. Among the plurality of circular pixels 10, the center pixel 201 and the peripheral pixels 202 are arranged in the same manner as described above, which will not be described herein again.

In this way, the pixel arrangement structure 10 includes circular pixels 10 capable of emitting light of at least three different colors, so that the circular pixels 10 emitting light of different colors may be independently controlled to realize color display.

Figure 8:
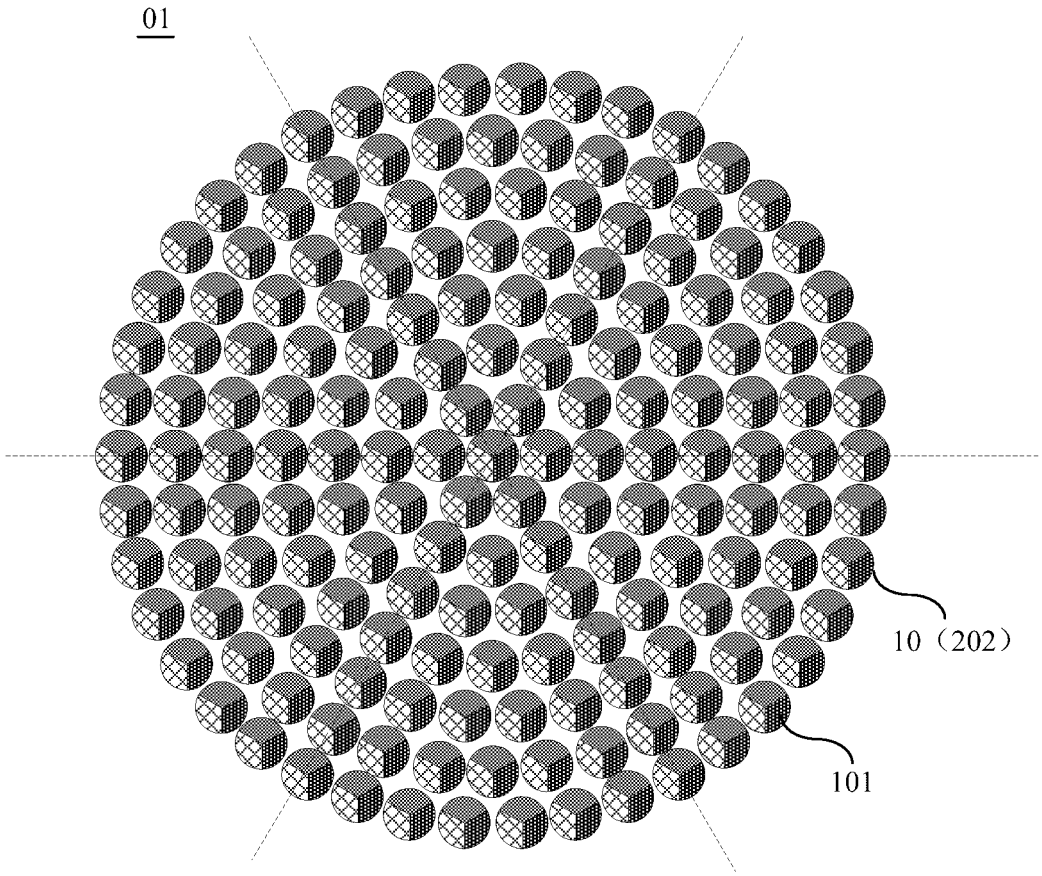
FIG. 8 is a schematic diagram showing another arrangement of each of circular pixels in the pixel arrangement structure shown in FIG. 2 when color display is realized based on the pixel arrangement structure.

Alternatively, taking the pixel arrangement structure 01 shown in FIG. 6 as an example, with consideration given to the colors of light emitted by the circular pixels 10 in the pixel arrangement structure 01, an arrangement manner of the center pixel 201 and the peripheral pixels 202 is for example as shown in FIG. 8—of the plurality of circular pixels 10 of the pixel arrangement structure 01, at least the center pixel 201 includes at least three sub-pixels 101 (R, G, and B), and the at least three sub-pixels 101 constitute a pixel unit for emitting white light.

Figure 9:
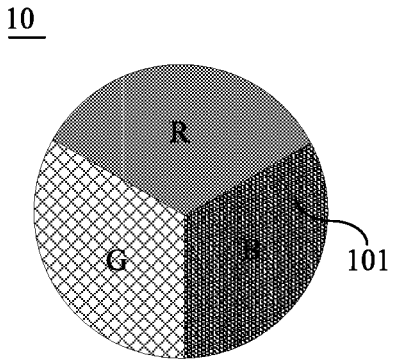
FIG. 9 is a diagram showing a structure of one of the circular pixels in FIG. 8.

In FIG. 8, a description is made by taking an example in which all the circular pixels 10 include three sub-pixels 101 (R, G, and B), as shown in FIG. 9.

In addition, any two sub-pixels 101 in each of the circular pixels 10 have equal areas. In this case, as shown in FIG. 9, a red (R) sub-pixel 101, a green (G) sub-pixel 101, and a blue (B) sub-pixel 101 may divide the circular pixel 10 into three equal parts, so that white light emitted by the circular pixel 10 is uniform in color.

On this basis, in a case where any one of the circular pixels 10 includes the at least three sub-pixels 101 described above, sub-pixels 101 emitting light of the same color are in the same position in different circular pixels 10.

For example, in FIG. 8, each of the circular pixels 10 includes three sub-pixels 101 (R, G, and B). In any one of the circular pixels, the red (R) sub-pixel is located above, the green (G) sub-pixel is located at the lower left, and the blue (B) sub-pixel 101 is located at the lower right.

In this way, each of the circular pixels 10 includes at least three sub-pixels 101 emitting light of different colors, so that each sub-pixel 101 in each of the circular pixels 10 is individually controlled to realize color display.

It will be noted that the above description is made by taking an example in which each of the circular pixels 10 includes at least three sub-pixels 101, and the three sub-pixels 101 emit red light (R), green light (G) and blue light (B) respectively. Of course, the three sub-pixels 101 may also emit cyan light, magenta light, and yellow light respectively. Alternatively, each of the circular pixels 10 may include four sub-pixels 101, and the four sub-pixels 101 emit red light (R), green light (G), blue light (B), and white light (W) respectively.

Some embodiments of the present disclosure provide a display panel, which includes any one of the pixel arrangement structures described above. The display device has the same technical effects as the pixel arrangement structure 01 provided by the above embodiments, which will not be repeated herein.

It will be noted that, in a case where the pixel arrangement structure 01 described above is adopted in a display panel, when the pixel arrangement structure 01 is in the shape of a circle as shown in FIG. 2, the display panel is in the shape of a circle; when the pixel arrangement structure 01 is in the shape of a semicircle as shown in FIG. 3, the display panel is in the shape of a semicircle; or when the pixel arrangement structure is in the shape of a quarter circle as shown in FIG. 4, the display panel is in the shape of a quarter circle. In addition, the above display panel may also be an irregular display panel formed by splicing the pixel arrangement structure 01 composed of circular pixels 10 provided by some embodiments of the present disclosure and a pixel arrangement structure 01 composed of ordinary rectangular sub-pixels together. The above display panels are all within the scope of protection of the present disclosure.

Figure 10:
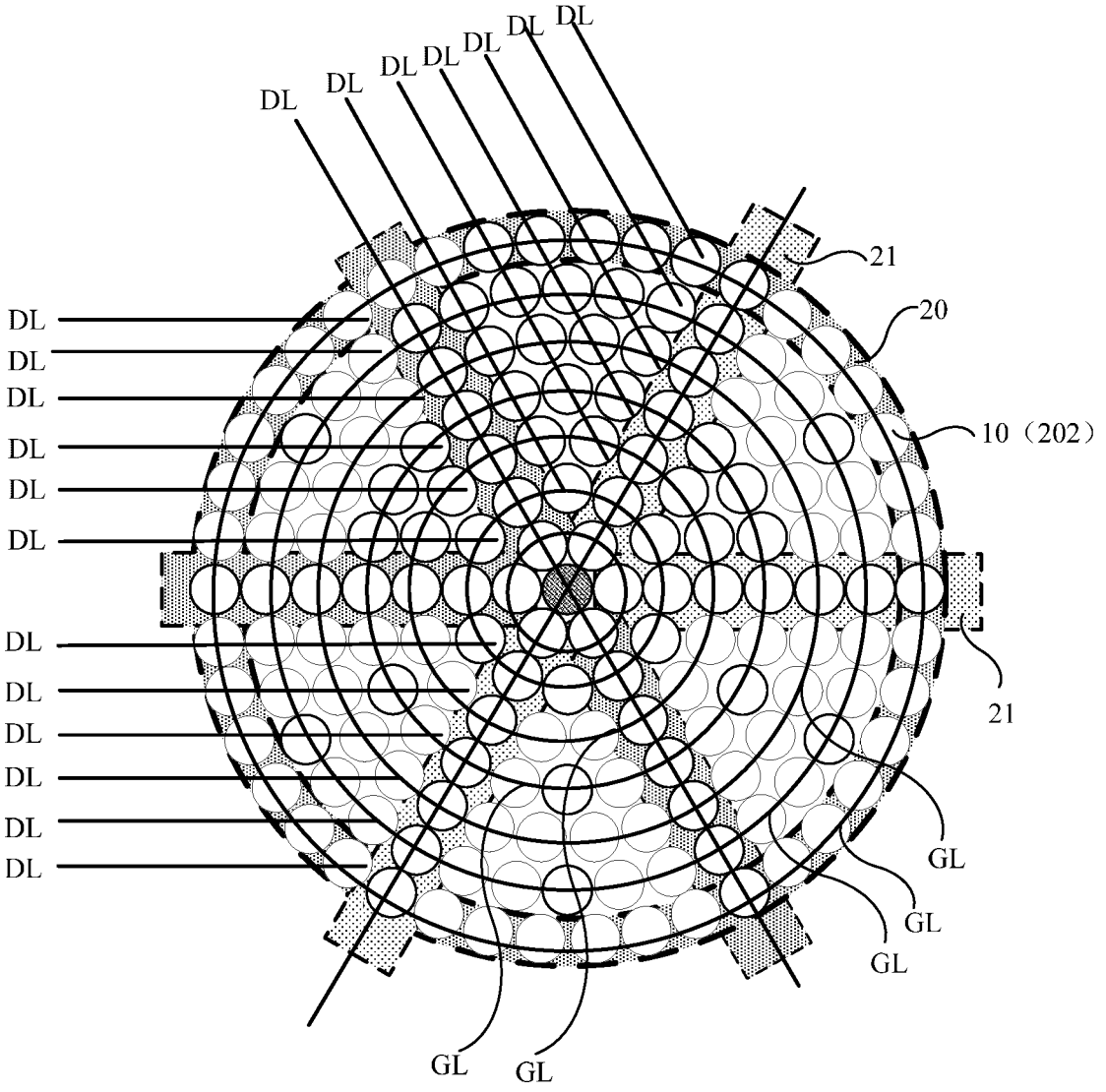
FIG. 10 is a schematic diagram showing a connection of data lines and gate lines with circular pixels in a display panel constructed using the pixel arrangement structure shown in FIG. 2.

On this basis, in a case where each circular pixel 10 emits light of a single color, in order to control the circular pixels 10 in the pixel arrangement structure 01, as shown in FIG. 10, in the pixel arrangement structure 01, peripheral pixels in each of first pixel groups 20 are connected to a same gate line GL.

In addition, peripheral sub-pixels 202 in different first pixel groups 20 whose centers are on a same straight line are connected to a same data line DL. In this case, peripheral pixels 202 in the same second pixel group 21 are connected to the same data line DL.

In this way, peripheral pixels 202 connected to the same gate line GL is connected to different date lines DL. Therefore, gate lines GL is scanned from the inside to the outside or from the outside to the inside to gate the gate lines GL. When one turn of the gate lines GL is gated, a data voltage Vdata is output to each of the peripheral pixels 202 connected to the gate line GL through different data lines, so that the peripheral pixels 202 may be charged to realize image display.

It will be noted that, FIG. 10 only shows how a portion of peripheral pixels 202 are connected to data lines DL, and remaining peripheral pixels 202 are connected to data lines DL in the same manner.

On this basis, the center pixel 201 is connected to the gate line GL and the data line DL in the following way: the center pixel 201 is connected to a same gate line GL as the peripheral pixels 202 in the first pixel group 20 closest to the center pixel 201. In this way, when the peripheral pixels 202 on a circumference closest to the center pixel 201 are gated, the center pixel 201 is also gated. In addition, since the center pixel 201 is connected to a same gate line GL as the peripheral pixels 202 in a first pixel group 20 closest to the center pixel 201, there is no need to fabricate a via hole for the gate line GL to be bridged in the process for the gate line GL to connect the center pixel 201 from the peripheral pixels 202 as described above.

Of course, the center pixel 201 may also be connected to a same gate line GL as peripheral pixels 202 in first pixel groups 20 other than the first pixel group 20 closest to the center pixel 201. In addition, as can be seen from the above, peripheral pixels 202 in a second pixel group 21 is connected to a same data line DL, and the center pixel 201 is connected to a same gate line GL as peripheral pixels 202 on a circumference closest to the center pixel 201. Therefore, in order to prevent a data signal received by the center pixel 201 from being incorrect, the center pixel 201 and the peripheral pixels 202 connected to the same gate line are connected to different data lines.

In some embodiments of the present disclosure, as shown in FIG. 10, in a case where the pixel arrangement structure 10 includes second pixel groups 21 and all peripheral pixels 202 on a circumference closest to the center pixel 201 are located in different second pixel groups 21, the center pixel 201 is connected to a same data line DL as a peripheral pixel 202 other than the peripheral pixels 202 closest to the center pixel 201.

Some embodiments of the present disclosure provide a display device, which includes any one of the display panels described above. The display device has the same technical effects as the display panels provided by the above embodiments, which will not be repeated herein.

It will be noted that, in some embodiments of the present disclosure, the display device described above is at least a liquid crystal display device. For example, the display device is any product or component having a display function such as a display, a television, a digital photo frame, a mobile phone, or a tablet computer.

The foregoing descriptions are merely some implementation manners of the present disclosure, but the protection scope of the present disclosure is not limited thereto, and the changes or replacements that any person skilled in the art can easily think of in the technical scope disclosed by the present disclosure should be within the protection scope of the present disclosure. Therefore, the protection scope of the present disclosure shall be subject to the protection scope of the claims.

What is claimed is:

1. A pixel arrangement structure, comprising a plurality of circular pixels, wherein the plurality of circular pixels comprise a center pixel and a plurality of peripheral pixels located around the center pixel, and some of the plurality of peripheral pixels distributed on a same circumference with the center pixel as a center constitute a first pixel group, so as to form a plurality of first pixel groups on different circumferences respectively, radiuses of circumferences of the plurality of first pixel groups respectively located on different circumferences gradually increase in a direction away from the center pixel, and a shape of the pixel arrangement structure is at least a part of a circle, the pixel arrangement structure further comprising at least two second pixel groups each of which is composed of some of the plurality of peripheral pixels, wherein peripheral pixels in each of the second pixel groups are respectively located on different circumferences in a direction close to or away from the center pixel; and in each of the second pixel groups, a center of each of the peripheral pixels is on a straight line as a center of the center pixel, and an angle between any two adjacent second pixel groups ranges from 58° to 62°, wherein among the plurality of circular pixels, at least the center pixel comprises at least three sub-pixels, and any two of the at least three sub-pixels have equal areas, and wherein the at least three sub-pixels constitute a pixel unit for emitting white light.

2. A display panel, comprising the pixel arrangement structure according to claim 1.

3. The display panel according to claim 2, wherein each of the plurality of circular pixels in the pixel arrangement structure emits light of a single color, and peripheral pixels in each of first pixel groups in the pixel arrangement structure are connected to a same gate line; and peripheral sub-pixels whose centers are on a same straight line and in different first pixel groups are connected to a same data line.

4. The display panel according to claim 3, wherein the center pixel and peripheral pixels in a first pixel group closest to the center pixel in the pixel arrangement structure are connected to a same gate line.

5. The display panel according to claim 4, wherein the center pixel and the peripheral pixels connected to the same gate line are connected to different data lines.

6. The display panel according to claim 5, wherein in cases where the pixel arrangement structure comprises second pixel groups, and all peripheral pixels closest to the center pixel are located in different second pixel groups, the center pixel and a peripheral pixel other than the peripheral pixels closest to the center pixel are connected to a same data line.

7. A display device, comprising the display panel according to claim 2.

* * * * *